US008200132B2

(12) United States Patent
Ito

(10) Patent No.: US 8,200,132 B2
(45) Date of Patent: Jun. 12, 2012

(54) IMAGE FORMING APPARATUS

(75) Inventor: Katsuyuki Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 547 days.

(21) Appl. No.: 12/320,618

(22) Filed: Jan. 30, 2009

(65) Prior Publication Data

US 2009/0202278 A1 Aug. 13, 2009

(30) Foreign Application Priority Data

Feb. 12, 2008 (JP) ..... 2008-030691

(51) Int. Cl.
*G03G 15/08* (2006.01)

(52) U.S. Cl. ..... 399/288

(58) Field of Classification Search ..... 399/288
See application file for complete search history.

(56) References Cited

U.S. PATENT DOCUMENTS

| | | | | |
|---|---|---|---|---|
| 4,459,009 | A * | 7/1984 | Hays et al. | 399/284 |
| 7,801,470 | B2 * | 9/2010 | Minegishi et al. | 399/265 |
| 2007/0274744 | A1 * | 11/2007 | Ito et al. | 399/281 |
| 2008/0063440 | A1 * | 3/2008 | Moon | 399/288 |

FOREIGN PATENT DOCUMENTS

| | | | |
|---|---|---|---|
| JP | 07-064445 | | 3/1995 |
| JP | 09138562 | A * | 5/1997 |

* cited by examiner

*Primary Examiner* — David Gray

*Assistant Examiner* — Erika J Villaluna

(74) *Attorney, Agent, or Firm* — Kubotera & Associates, LLC

(57) ABSTRACT

An image forming apparatus includes an image supporting member; a developing belt for supporting and transporting developer to develop a static latent image formed on the image supporting member; a developer supply member disposed to abut against the developing belt to form a specific nip portion for supplying the developer to the developing belt; a first voltage applying member for applying a first voltage to the developing belt at a first position; a second voltage applying member for applying a second voltage to the developing belt at a second position; and a third voltage applying member for applying a third voltage to the developer supply member. It is configured such that the developer supply member abuts against the developing belt between the first position and the second position.

19 Claims, 3 Drawing Sheets

IMAGE FORMING APPARATUS

BACKGROUND OF THE INVENTION AND RELATED ART STATEMENT

The present invention relates to an image forming apparatus.

In a conventional image forming apparatus such as a printer, a copier, a facsimile, a multi-function product, and the likes, a charge roller uniformly charges a surface of a photosensitive drum. An LED (Light Emitting Diode) head exposes the surface of the photosensitive drum to form a static latent image. A developing device develops the static latent image to form a toner image. A transfer roller transfers the toner image to a sheet, and a fixing device fixes the toner image to the sheet, thereby forming an image on the sheet.

The developing device is generally use toner of a one-component type. In the developing device, a tone supply roller supplies toner to a developing roller, and the developing roller attaches toner to the static latent image, thereby developing the static latent image. The toner supply roller is formed of a sponge. Accordingly, the toner supply roller tends to have a short lifetime. When a surface of the toner supply roller is deteriorated, an amount of toner supplied to the developing roller varies, thereby varying a density of an image.

To this end, instead of the developing roller, there has been proposed a developing device using a developing belt. In this case, the developing device includes a drive roller, a follower roller, and the developing belt. When the photosensitive drum rotates, the developing belt moves. It is possible to adjust a pressure between the toner supply roller and the developing belt through adjusting an extension force applied to the developing belt. Accordingly, it is possible to prolong a lifetime of the toner supply roller, and to stabilize a density of an image (refer to Patent Reference).

Patent Reference: Japanese Patent Publication No. 07-064445

In the conventional image forming apparatus described above, the toner supply roller directly abuts against the developing belt, and a voltage is applied to the toner supply roller for supplying toner to the developing belt. Accordingly, it is difficult to scrape off unused toner remaining on the developing belt with the toner supply roller. As a result, the next developing operation is performed with toner still remaining on the developing belt, thereby causing an afterimage and lowering image quality.

In view of the problems described above, an object of the present invention is to provide an image forming apparatus capable of solving the problems of the conventional image forming apparatus. In the image forming apparatus of the present invention, it is possible to prevent an afterimage from occurring and improve image quality.

Further objects of the invention will be apparent from the following description of the invention.

SUMMARY OF THE INVENTION

In order to attain the objects described above, an image forming apparatus includes an image supporting member; a developing belt for supporting and transporting developer to develop a static latent image formed on the image supporting member; a developer supply member disposed to abut against the developing belt to form a specific nip portion for supplying the developer to the developing belt; a first voltage applying member for applying a first voltage to the developing belt at a first position; a second voltage applying member for applying a second voltage to the developing belt at a second position; and a third voltage applying member for applying a third voltage to the developer supply member.

Further, according to the present invention, it is configured such that the developer supply member abuts against the developing belt between the first position and the second position.

In the present invention, the image forming apparatus includes the image supporting member; the developing belt for supporting and transporting developer to develop the static latent image formed on the image supporting member; the developer supply member disposed to abut against the developing belt to form the specific nip portion for supplying the developer to the developing belt; the first voltage applying member for applying the first voltage to the developing belt; the second voltage applying member for applying the second voltage to the developing belt; and the third voltage applying member for applying the third voltage to the developer supply member.

Further, in the present invention, it is configured such that the developer supply member abuts against the developing belt between the first position and the second position.

As described above, the developer supply member disposed to abut against the developing belt. The first voltage and the second voltage are applied to the developing belt, and the third voltage is applied to the developer supply member. Accordingly, an electric field is generated at an abutting portion, i.e., a frontend portion of the nip portion, for moving the developer from the developer supply member to the developing belt. Further, another electric field is generated at a separating portion, i.e., a rear end portion of the nip portion, for moving the developer from the developing belt to the developer supply member. As a result, it is possible to supply a sufficient amount of the developer to the developing belt, and to securely collect unused developer remaining on the developing belt. Therefore, it is possible to prevent an afterimage from occurring and improve image quality.

DETAILED DESCRIPTION OF THE PREFERRED EMBODIMENTS

Hereunder, embodiments of the present invention will be described in detail with reference to the accompanying drawings. In the following description, a printer will be described as an image forming apparatus.

First Embodiment

Figure 1:
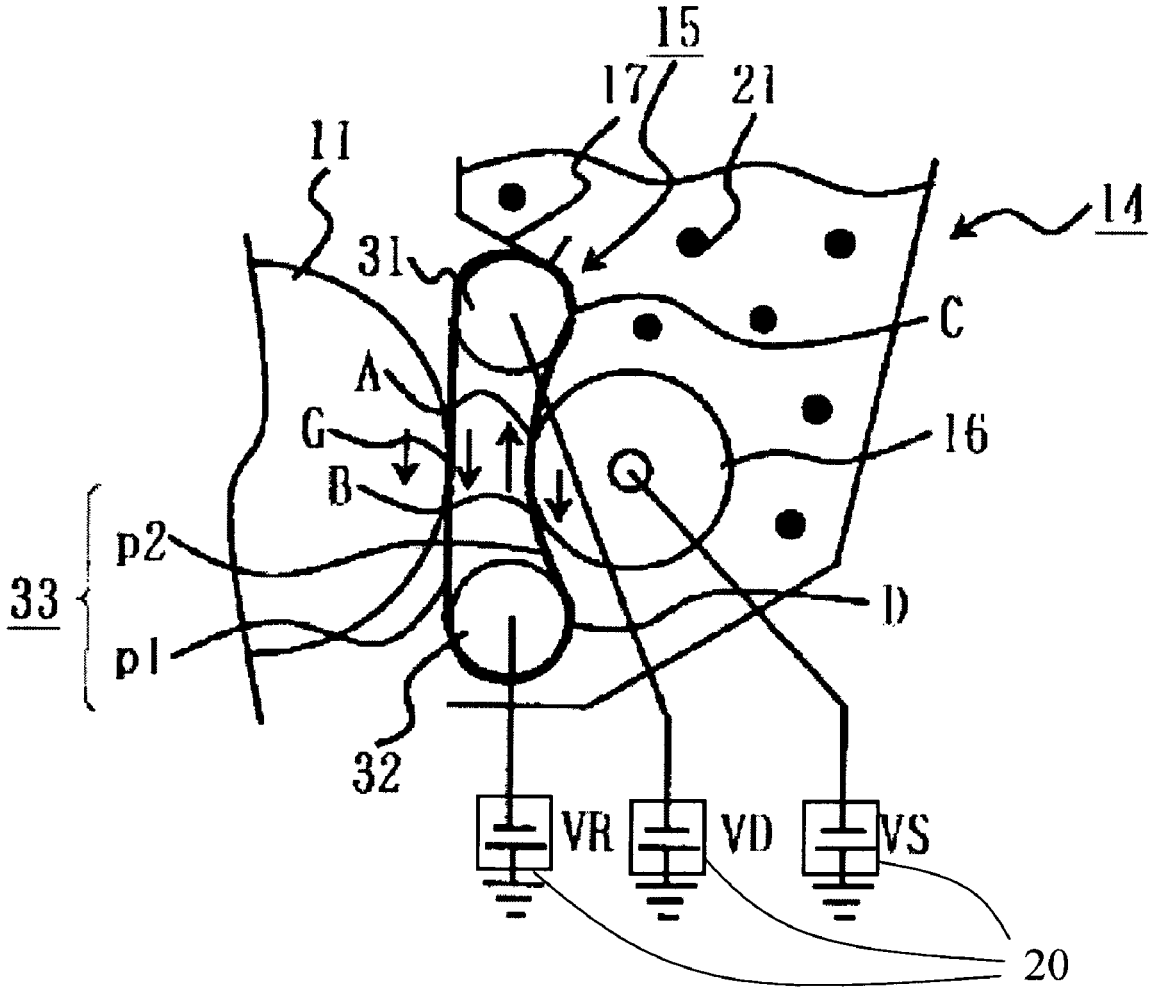
FIG. 1 is a schematic view showing a main portion of a printer according to a first embodiment of the present invention.
Figure 2:
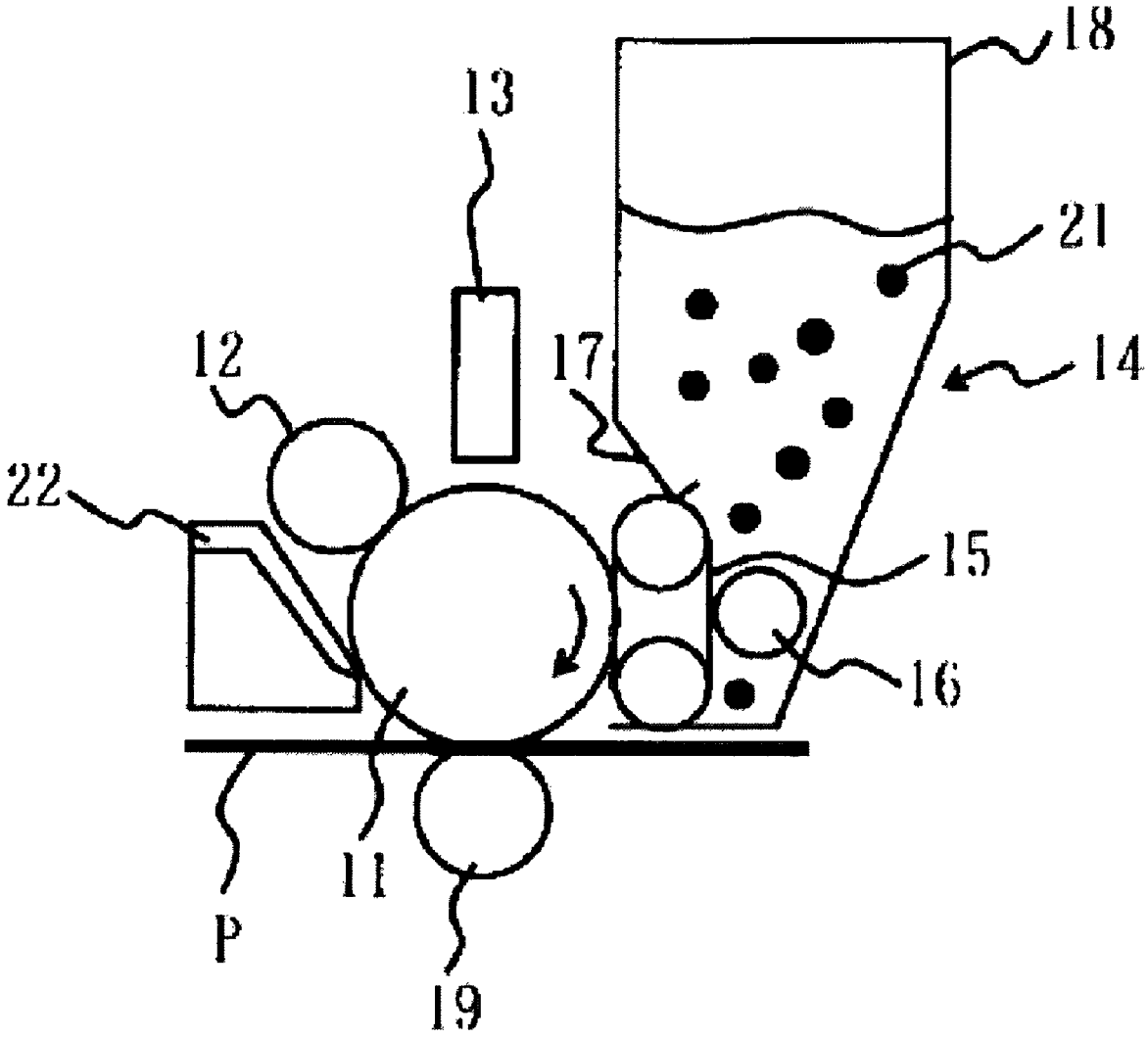
FIG. 2 is a schematic view showing the printer according to the first embodiment of the present invention.

A first embodiment of the present invention will be explained. FIG. 1 is a view showing a main portion of a printer according to the first embodiment of the invention. FIG. 2 is a view showing the printer according to the first embodiment of the invention.

As shown in FIG. 1, the printer includes a photosensitive drum 11 as an image supporting member having a photosensitive member made of an organic semiconductor on a surface thereof; and a charging roller 12 for applying an electric charge on the surface of the photosensitive drum 11 so as to uniformly charge the surface at about −600 V. The charging roller 12 rotates following the rotation of the photosensitive drum 11 and receives a negative voltage.

In the embodiment, the printer further includes an LED (Light Emitting Diode) head 13 as an exposing device for forming a static latent image through exposing the surface of the photosensitive drum 11. The LED head 13 is used as the exposing device, and a laser may be provided instead of the LED head 13.

In the embodiment, the printer further includes a developing device 14. The developing device 14 includes a developing belt device 15; a toner supply roller 16 as a developer supply member for supplying toner 21 as developer to the developing belt device 15; a developing blade 17 as a restricting member for forming a thin layer of the toner 21 on the developing belt device 15; and a toner hopper 18 as a developer container for storing the toner 21 in an unused state.

In the embodiment, the developing belt device 15 includes a driving roller 31 as a first rotational member (roller); a follower roller 32 as a second rotational member (roller); and a developing belt 33 provided between the driving roller 31 and the follower roller 32. When a driving device (not illustrated) drives the driving roller 31 to rotate the driving roller 31, the developing belt 33 moves, and the follower roller 32 rotates. The developing belt 33 is disposed to contact with or abut against the photosensitive drum 11. When the developing belt 33 moves, the developing belt 33 conveys and transports the toner 21, so that an electrostatic latent image formed on the photosensitive drum 11 is developed, thereby forming a toner image as a developer image.

In the embodiment, the developing belt 33 includes a first section p1 on a side thereof contacting with the photosensitive drum 11 and a second section p2 on a side thereof contacting with the toner supply roller 16. The developing belt 33 travels in a forward direction relative to a rotational direction of the photosensitive drum 11, i.e., from the driving roller 31 to the follower roller 32, in the first section p1. The developing belt 33 travels in a counter direction relative to a rotational direction (moving direction) of the toner supply roller 16, i.e., from the follower roller 32 to the driving roller 31, in the second section p2.

In the embodiment, an urging member (not illustrated) such as a coil spring urges the follower roller 32 in a direction away from the driving roller 31, so that a certain tensile force is applied onto the developing belt 33. The photosensitive drum 11 is arranged such that the first section p1 contacts with the photosensitive drum 11 through a substantially linear contact, thereby forming a contact section G between the developing belt 33 and the photosensitive drum 11. In the contact section G, the developing belt 33 travels at a traveling speed of 1.1 to 1.3 times that of the photosensitive drum 11.

In the embodiment, the toner supply roller 16 contacts with the developing belt 33 to form a specific nip portion (overlapping section). When the toner supply roller 16 rotates, the toner supply roller 16 contacts with the developing belt 33 at an abutting portion A thereof, i.e., a frontend portion of the nip portion, and moves away from the developing belt 33 at a separating portion B thereof, i.e., a rear end portion of the nip portion.

In the embodiment, the toner supply roller 16 is situated at a position such that the toner supply roller 16 slightly overlaps with the driving roller 31 and the follower roller 32, and the second section p2 contacts with the toner supply roller 16 through a surface contact. Accordingly, the toner supply roller 16 pushes the second section p2 with a specific pressure, and the second section p2 is curved to surround the toner supply roller 16 over a specific range. The nip portion is formed between the developing belt 33 and the toner supply roller 16. In the nip portion, the developing belt 33 travels at a speed substantially same as a circumferential speed of the toner supply roller 16.

In the embodiment, after the toner image is formed on the photosensitive drum 11, a transfer roller 19 as a transfer member transfers the toner image to a sheet P as a recording medium. Then, the sheet P is transported to a fixing device (not shown), and the fixing device fixes the toner image to the sheet P, thereby forming an image on the sheet P. After the toner image is transferred, a cleaning blade 22 as a cleaning member scrapes off the toner 21 remaining on the photosensitive drum 11.

In the embodiment, the driving roller 31 and the follower roller 32 are made of a conductive material such as metal, and have metal shafts. The developing belt 32 is made of an elastomer or a resin having a high volume resistance. The elastomer includes a rubber material such as a silicone rubber, a urethane rubber, and the likes. The resin includes a polymer resin such as a polyimide, a polyamide, and a polyurethane. The developing belt 33 has a volume resistivity of at least about $10^5$ Ωcm and not higher than $10^8$ Ωcm, and a surface roughness $R_z$ of at least 2 μm and not higher than 10 μm. The developing belt 33 may include a coating layer on a surface thereof.

In the embodiment, the developing blade 17 is made of a thin metal plate having elasticity, and contacts with the surface of the developing belt 33 at a bending section near a tip thereof at a specific pressure. The toner supply roller 16 is a metal shaft coated with a material such as a urethane resin, a polyimide resin, a CR rubber, a CR rubber, and a silicone rubber. The toner supply roller 16 has a volume resistivity of at least $10^7$ Ωcm and not higher than $10^9$ Ωcm and a surface roughness Rz of at least 5 μm and not higher than 30 μm.

In the embodiment, the toner 21 is a one-component developing toner, and includes a toner main body and an external additive such as silica. The toner main body contains a resin component such as a polyester and a polystyrene, a colorant, a mold-releasing agent, and a charge control agent. The toner 21 has a spherical shape formed with a pulverization or a polymerization method, and has a volume average particle size of at least 3 μm and not greater than 10 μm, and a sphericity of at least 0.90 and not higher than 0.98. The toner 21 is controlled to have charge (blow-off charge) of at least −50 μC/g and not higher than −10 μC/g with the charge control agent, the external additive, or the like.

In the embodiment, a high voltage applying device, i.e., a main power source 20, is provided for applying a high voltage. The driving roller 31 and the main power source 20 constitute a first voltage applying device or a first voltage applying member; the follower roller 32 and the main power source 20 constitute a second voltage applying device or a second voltage applying member; and the main power source 20 constitutes a third voltage applying device or a third voltage applying member. The first voltage applying member applies a first voltage VD to the driving roller 31; the second voltage applying member applies a second voltage VR to the follower roller 32, and the third voltage applying member applies a third voltage VS to the toner supply roller 16. The third voltage VS has a value between those the first and second voltages VD and VR, so that absolute values of the first to third voltages |VD|, |VR|, and |VS| satisfy the relation of $|VD|<|VS|<|VR|$.

An operation of the developing device 14 will be described next. When an image formation process starts, the driving device drives the photosensitive drum 11, the driving roller 31, and the toner supply roller 16 to rotate or travel in an arrow direction. The toner supply roller 16 adheres the toner 21 fed from the toner hopper 18 on a surface thereof with a certain adhesive force, and conveys the toner 21 to the developing belt device 15. At this time, the adhesive force is generated through the van der Waals force and a fine Coulomb force due to a surface roughness of the toner supply roller 16.

The voltages VD, VR, and VS are applied to the driving roller 31, the follower roller 32, and the toner supply roller 16, respectively. At this time, a voltage is generated at the abutting portion A in an amount of a potential difference between the voltages VD and VR divided by distances L1 and L2 (substantially, resistances of the developing belt 33 at the distances L1 and L2). The distance L1 is a distance from the abutting portion A to a point C where the second section p2 contacts with the driving roller 31 (where the developing belt 33 contacts with the driving roller 31 with traveling of the developing belt 33), and the distance L2 is a distance from the abutting portion A to a point D where the second section p2 contacts with the follower roller 32 (where the developing belt 33 separates from the follower roller 32). The abutting portion A is close to the driving roller 31, so that the voltage is similar to the voltage VD.

For example, when a distance between the points C and D is 20 mm and the distance L1 is 2 mm, the distance L2 is 18 mm. When the voltages VD, VR, and VS are set 0, −400, and −200 V, respectively, the voltage Va at the abutting portion A is −40 V. In addition, when the voltage VS of −200 V is applied to the toner supply roller 16, an electrical field is formed for transporting the toner 21 charged negatively from the toner supply roller 16 to the surface of the developing belt 33.

Accordingly, after the toner 21 is adhered on the toner supply roller 16 and sent to the developing belt device 15, the toner 21 contacts with the developing belt 33 at the abutting portion A, and adheres to the developing belt 33. When the developing belt 33 travels, the developing blade 17 forms a thin layer of the toner 21 adhering to the developing belt 33. A certain voltage VL may be applied to the developing blade 17 for adjusting a charge amount and a layer thickness of the toner 21. After the toner 21 passes through the blade 17, the toner 21 contacts with the photosensitive drum 11 to develop the electrostatic latent image on the photosensitive drum 11.

In the embodiment, a voltage is generated at the contact section G in an amount of a voltage between the voltages VD and VR, i.e., a potential difference between the voltages VD and VR divided by distances L11 and L12 (substantially, resistances of the developing belt 33 at the distances L11 and L12). The distance L11 is a distance from the contact section G to a point where the first section p1 contacts with the driving roller 31 (where the developing roller 33 separates from the driving roller 31), and the distance L12 is a distance from the contact section G to a point where the first contact section G contacts with the follower roller 32 (where the developing belt 33 contacts with the follower roller 32).

For example, when the contact section G is in the center of the first section p1, the distances L11 and L12 are equal to each other, and the voltage Vg at the contact section G is −200 V. In addition, since a surface of the photosensitive drum 11 has a potential of about −600 V, when the toner adheres to the developing belt 33 and is sent to the photosensitive drum 11, the toner 21 contacts with the photosensitive drum 11 at the contact section G, adheres on the photosensitive drum 11, and inversely develops the electrostatic latent image on the photosensitive drum 11.

After the developing belt 33 passes the contact section G, the toner 21 not used for developing remains on the developing belt 33. After the toner 21 passes through the follower roller 32, the toner 21 is transported to the separating portion B. At this time, a voltage is generated at the separating section B in an amount of a potential difference between the voltages VD and VR divided by distances L3 and L4 (substantially, resistances of the developing belt 33 at the distances L3 and L4). The distance L3 is a distance from the separating portion B to the point C, and the distance L4 is a distance from the separating portion B to the point D. The separating portion B is close to the follower roller 32, so that the voltage is similar to the voltage VR.

For example, when the distance between the point c and the point D is 20 mm and the distance L3 is 18 mm, the distance L4 is 2 mm. When the voltages VD, VR, and VS are set 0, −400, and −200 V, respectively, the voltage Vb at the separating portion B is −360 V. In addition, since the voltage VS applied on the toner supply roller 16 is −200 V, an electrical field is formed for transporting the toner 21 charged negatively from the developing belt 33 to the surface of the toner supply roller 16.

After the toner 21 is transported to the surface of the toner supply roller 16, when the toner supply roller 16 rotates, the toner 21 is supplied to the abutting portion A together with the toner 21 supplied from the toner hopper 18. As described above, during the image formation process, the toner 21 is repeatedly supplied to and collected from the developing belt device 15 with the toner supply roller 16.

As described above, in the embodiment, the wide nip portion is formed between the toner supply roller 16 and the developing belt 33. The electric field is formed at the abutting portion A for transferring the toner 21 charged negatively from the toner supply roller 16 to the surface of the developing belt 33. The electric field is formed at the separating portion B for transferring the toner 21 charged negatively from the developing belt 33 to the surface of the toner supply roller 16. Accordingly, it is possible to feed an enough amount of the toner 21 to the developing belt device 15 and to surely collect the toner 21 not used and remaining on the developing belt 33, thereby preventing an afterimage and improving image quality.

Furthermore, in the embodiment, the toner 21 is not mechanically scraped off but electrically collected. Accordingly, it is possible to prevent the toner 21 from being mechanically damaged due to friction between the developing belt 33 and the toner supply roller 16. In addition, when the toner 21 moves to the surface of the toner supply roller 16 while the toner supply roller 16 rotates, the toner 21 is further transported to the abutting portion A, thereby preventing the toner 21 collected from accumulating in the developing device 14.

In the embodiment, the coil spring is provided for adjusting the tensile force exerted onto the developing belt 33, so that it is possible to reduce the contact pressure between the toner supply roller 16 and the developing roller 33. As a result, it is possible to prolong the lifetime of the toner supply roller 33, and to prevent the surface shape of the toner supply roller 16 from deteriorating. Accordingly, it is possible to stably supply the toner 21 to the developing belt device 15, thereby stabilizing a density of an image. In addition, it is possible to reduce the contact force between the toner supply roller 16 and the developing belt 33, thereby preventing the toner 21 from deteriorating due to friction between the developing belt 33 and the toner supply roller 16.

In the embodiment, the contact pressure between the toner supply roller 16 and the developing belt 33 is at least 5 g/cm$^2$ and not greater than 20 g/cm$^2$.

Second Embodiment

A second embodiment of the present invention will be described next. Components in the second embodiment similar to those in the first embodiment are designated with the same reference numeral, and provide effects similar to those in the first embodiment.

Figure 3:
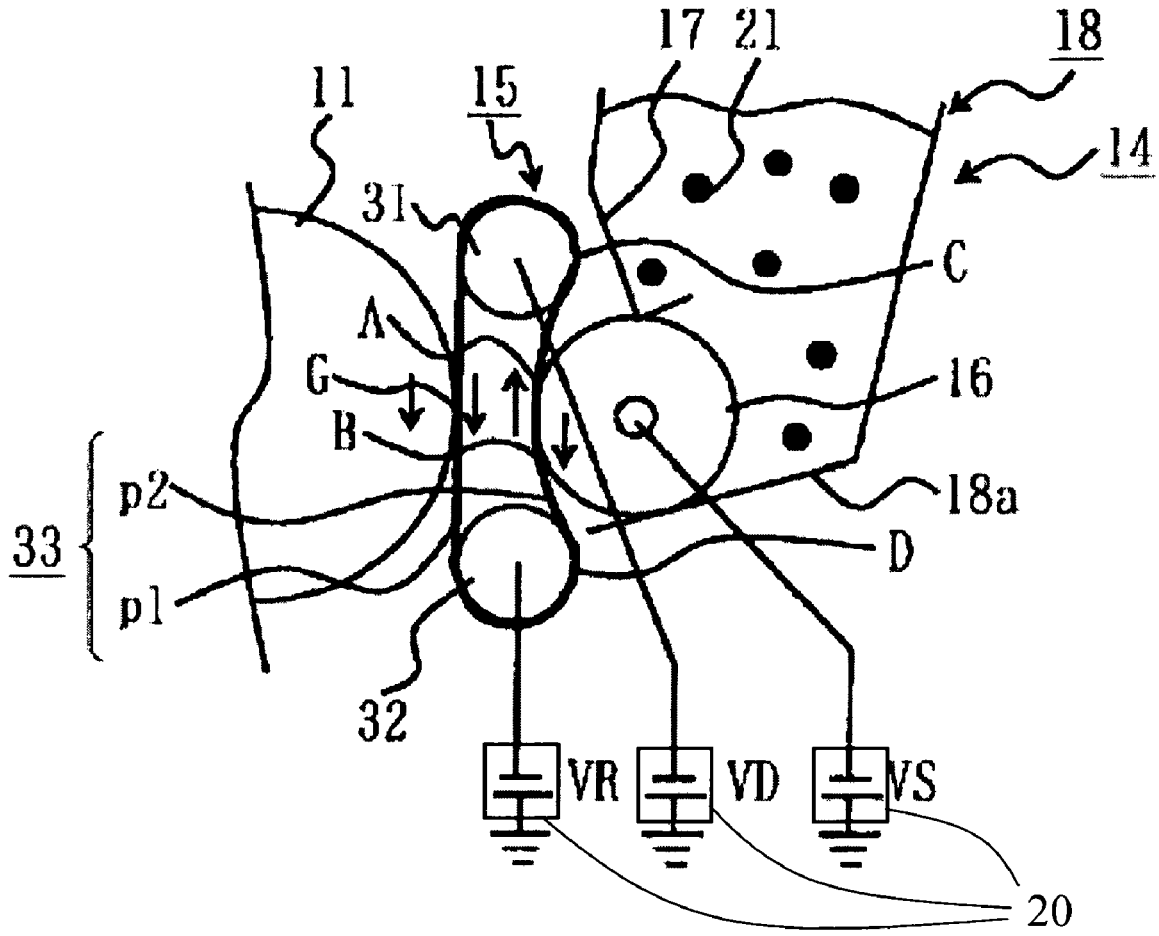
FIG. 3 is a schematic view showing a main portion of a printer according to a second embodiment of the present invention.

FIG. 3 is a schematic view showing a main portion of a printer according to a second embodiment of the present invention. As shown in FIG. 3, the printer includes the developing blade 17 as a restricting member contacting with the toner supply roller 16 as the developer supply member. The printer further includes the toner hopper 18 as the developing container having a bottom plate 18*a*. The bottom plate 18*a* is made of a film and the likes, and contacts with the toner supply roller 16.

An operation of the developing device 14 will be described. When the image formation process starts, the driving device drives the photosensitive drum 11 as the image supporting member, the driving roller 31 as the first rotational member of the developing belt device 15, and the toner supply roller 16 to rotate or travel in an arrow direction.

Then, the toner supply roller 16 adheres the toner 21 as the developer fed from the toner hopper 18 through a specific adhesive force, and conveys the toner 21 to the developing belt device 15. Then, the toner 21 adhered on the toner supply roller 16 contacts with the developing blade 17 to be formed in a thin layer, and moves from the toner supply roller 16 to the developing belt 33 at the abutting portion A according to the potential difference.

In addition, the toner 21 not used in the developing is collected at the separating portion B from the developing belt 33 to the toner supply roller 16, and is returned to the toner hopper 18 through the bottom plate 18*a* of the toner hopper 18.

In the embodiment, the toner supply roller 16 has the developing blade 17, so that the toner 21 not used in the developing is not fed to the developing belt device 15. Accordingly, it is possible to prevent the toner 21 from deteriorating and stably obtain an image.

In the embodiment, it is possible to prevent the toner 21 in the developing device 14 from leaking, i.e., toner leakage, through sealing with the film. It is easier to seal at the toner supply roller 16 than at the developing belt 33, thereby securely preventing the toner leakage.

In the embodiments described above, the present invention is applied to the printer, and is applicable to a copier, facsimile, a multi-function product, and the likes.

The disclosure of Japanese Patent Application No. 2008-030691, filed on Feb. 12, 2008, is incorporated in the application by reference.

While the invention has been explained with reference to the specific embodiments of the invention, the explanation is illustrative and the invention is limited only by the appended claims.

What is claimed is:

1. An image forming apparatus comprising:

an image supporting member;

a developing belt for supporting and transporting developer to develop a static latent image formed on the image supporting member;

a developer supply member disposed to abut against the developing belt to form a specific nip portion for supplying the developer to the developing belt;

a first voltage applying member for applying a first voltage to the developing belt at a first position;

a second voltage applying member for applying a second voltage to the developing belt at a second position so that the developer supply member abuts against the developing belt between the first position and the second position; and a third voltage applying member for applying a third voltage to the developer supply member, wherein said first voltage applying member and said second voltage applying member include a first rotational member and a second rotational member, respectively, for extending the developing belt so that the image supporting member abuts against the developing belt between the first rotational member and the second rotational member, and said developing belt is arranged to move at a seed of 1.1 to 1.3 times that of the image supporting member.

2. The image forming apparatus according to claim 1, wherein said third voltage applying member is adopted to apply the third voltage having a value between those of the first voltage and the second voltage.

3. The image forming apparatus according to claim 1, wherein said first voltage applying member is adopted to apply the first voltage and said third voltage applying member is adopted to apply the third voltage so that an electric field is generated for transporting the developer from the developer supply member to the developing belt.

4. The image forming apparatus according to claim 1, wherein said second voltage applying member is adopted to apply the second voltage and said third voltage applying member is adopted to apply the third voltage so that an electric field is generated for transporting the developer from the developing belt to the developer supply member.

5. The image forming apparatus according to claim 1, where said image supporting member receives a voltage so that an electric field is generated for transporting the developer from the developing belt to the image supporting member.

6. The image forming apparatus according to claim 1, where said developing belt is adopted to move in a direction opposite to a direction that the developer supply member.

7. The image forming apparatus according to claim 1, wherein said first voltage applying member and said second voltage applying member include a power source for applying the first voltage and the second voltage.

8. The image forming apparatus according to claim 1, further comprising a restricting member abutting against the developing belt for forming a thin layer of the developer.

9. The image forming apparatus according to claim 1, further comprising a restricting member abutting against the developer supply member for forming a thin layer of the developer.

10. The image forming apparatus according to claim 1, wherein said developing belt is formed of a resin or an elastic member having a high volume resistivity.

11. The image forming apparatus according to claim 1, wherein said developing belt has a volume resistivity of at least about $10^5$ Ωcm and not higher than $10^8$ Ωcm.

12. The image forming apparatus according to claim 1, wherein said developer supply member has a volume resistivity of at least $10^7$ Ωcm and not higher than $10^9$ Ωcm.

13. The image forming apparatus according to claim 1, wherein said developing belt is arranged to move at a speed substantially equal to that of the developer supply member.

14. The image forming apparatus according to claim 1, wherein said developing belt has a surface roughness of at least 2 μm and not higher than 10 μm.

15. The image forming apparatus according to claim 1, wherein said developer supply member has a surface roughness of at least 5 μm and not higher than 30 μm.

16. The image forming apparatus according to claim 1, wherein said developer supply member is arranged to supply the developer having a charge amount of at least −50 μC/g and not higher than −10 μC/g.

17. The image forming apparatus according to claim 1, wherein said developer supply member is arranged to abut against the developing belt with a contact pressure at least 5 $g/cm^2$ and not greater than 20 $g/cm^2$.

18. The image forming apparatus according to claim 1, wherein said developing belt is arranged to contact with the image supporting member through a substantially linear contact.

19. The image forming apparatus according to claim 1, wherein said first rotational member is arranged to move the developing belt so that the second rotational member follows a movement of the developing belt.

* * * * *